US007492280B2

(12) United States Patent
Horler

(10) Patent No.: US 7,492,280 B2
(45) Date of Patent: Feb. 17, 2009

(54) WIRELESS REMOTE CONTROL SYSTEMS

(76) Inventor: Gregory Douglas Horler, Low Fold, Doctor Lane, Shelley (GB) HD8 8HK ( * ) Notice: Subject to any disclaimer, the term of this patent is extended or adjusted under 35 U.S.C. 154(b) by 96 days.

(21) Appl. No.: 10/503,315

(22) PCT Filed: Jan. 31, 2003

(86) PCT No.: PCT/GB03/00404

§ 371 (c)(1),
(2), (4) Date: Apr. 26, 2005

(87) PCT Pub. No.: WO03/065326

PCT Pub. Date: Aug. 7, 2003

(65) Prior Publication Data

US 2005/0174255 A1 Aug. 11, 2005

(30) Foreign Application Priority Data

Jan. 31, 2002 (GB) ..... 0202270.5
Jan. 31, 2002 (GB) ..... 0202271.3

(51) Int. Cl.
*G08C 17/00* (2006.01)

(52) U.S. Cl. ..... 340/870.01; 342/42; 340/870.3; 340/539.1

(58) Field of Classification Search ..... 340/870.01, 340/870.18, 870.3, 539.1; 342/42; 310/318; 455/63.1

See application file for complete search history.

(56) References Cited

U.S. PATENT DOCUMENTS

| | | | | |
|---|---|---|---|---|
| 3,324,724 | A | 6/1967 | Heyer et al. | |
| 5,444,448 | A * | 8/1995 | Schuermann et al. | 342/42 |
| 5,974,301 | A * | 10/1999 | Palmer et al. | 455/63.1 |
| 6,060,815 | A * | 5/2000 | Nysen | 310/318 |

FOREIGN PATENT DOCUMENTS

| | | |
|---|---|---|
| EP | 8 391 127 A | 2/1989 |
| JP | S52-010348 U | 3/1977 |
| JP | S60-079115 | 5/1985 |
| JP | H01-112186 A | 4/1989 |
| JP | H04-065800 A | 3/1992 |

* cited by examiner

*Primary Examiner*—Albert K Wong
(74) *Attorney, Agent, or Firm*—Burns & Levinson LLP; Jerry Cohen

(57) ABSTRACT

Wireless remote control system for engine piston with in-piston circuit (50) and an external processing unit mounted on the exterior of the crank case (51). A carrier signal generated in the external processing unit is fed to a primary coil (P) located within the crank case and the secondary coil (S), loosely coupled to coil (P) and tuned for resonance therewith is located in the skirt of the piston. The secondary coil picks up a carrier signal from the primary coil and the carrier signal is rectified, smoothed and regulated to provide DC power to a micro controller in the piston circuit. The micro controller may use data from a number of sensors to modulate the signal in the secondary coil, which modulation is picked up by the primary coil and thus sensor data is transmitted to the external processing unit where it is filtered and decoded.

13 Claims, 5 Drawing Sheets

WIRELESS REMOTE CONTROL SYSTEMS

RELATED APPLICATIONS

This Patent application is a 35 U.S.C. §371 National Phase Entry of International Application PCT/GB03/00404, filed 31 Jan. 2003 with priority of United Kingdom applications 0202271.3 and 0202270.5 both, filed 31 Jan. 2002.

BACKGROUND AND FIELD OF THE INVENTION

The present invention relates to improvements in the design and operation of wireless remote control systems, and is particularly, although not exclusively, concerned with telemetry systems, whereby sensors are controlled and monitored remotely so as to monitor conditions in a harsh environment such as, for example, an engine or a gearbox. The applicant's own paper, "A Digital Electronic Solution to Piston Telemetry", SAE Technical paper series no. 2000-01-2032, discloses a prior telemetry system for use in a piston.

Wireless piston telemetry in which a transceiver mounted within a piston transmits signals from one or more sensors to a base station, situated outside the hostile environment of the piston, has provided a more versatile and more useful means of monitoring the conditions to which pistons are subjected, than have prior, hard-wired systems, which involve complicated electrical connections between the sensor(s) and the processing unit (base station) which is typically mounted externally of the piston and, usually, on the wall of the crankcase. However, even the prior art wireless systems are subject to problems.

For example, the piston circuitry must have a power source in order to transmit signals from the sensor to the processing unit. A known prior art system uses a battery, located in situ with the sensors and their associated circuitry, including a transceiver, to supply the circuitry with power. In order to supply power to the circuitry a switch must be closed. However, this has to be done before the piston is installed in the engine, and once the piston is installed the switch can only be accessed by dismantling the engine. Because of this the power remains "on" and the battery continues to discharge for as long as the piston is in the engine. Furthermore, the average lifespan of the conventional batteries is approximately 4 hours, and standard engine testing techniques require engines to run continuously for up to 100 hours.

To overcome the problem of the lifetime of the battery, power generation systems have been proposed which aim to recharge the battery mounted within the piston. However, those currently available require the piston to be modified and/or cause other components to perform in such a way that the motion of the piston may be influenced. This causes the engine to function other than as intended, and possibly increases the temperature inside the piston, which has an adverse effect on the circuitry inside the piston. Therefore any results obtained may be subject to errors.

A further problem with prior wireless telemetry systems is that even though the battery may be charged when the engine is running, as soon as the engine is switched off the battery begins to discharge, since the circuit is still operational and drawing a current. If the battery discharges fully before the engine is switched on again, there will be no energy in the battery to perform pre-runtime checks.

Turning on the engine would cause the battery to re-charge, and, provided the circuit could be turned on, measurements could then be taken, as the circuit would be fully operational. However, pre-runtime checks, with an inactive engine, would be impossible. It would therefore be desirable to be able to turn off the circuit to conserve charge, and to turn it on again at a chosen time. However, if the circuit is in an off state, it would not ordinarily be receptive to an instruction to turn on.

A further, related problem arises if the telemetry system is arranged for continuous transmission of data—i.e. one-way communication—which is sometimes preferred. The circuit may be transmitting data continuously from a single sensor or else from a plurality of sensors which are polled sequentially. In either case the operator cannot change the operational mode of the circuit, either to alter the sequence or to turn off the circuit, because the circuit is transmitting only—i.e. it is "talking" but not "listening". One possible solution to this is to arrange for the circuit to cease transmission periodically and to "listen" for an instruction in its quiet periods. This is not ideal, as the circuit must repeatedly break transmission in case an instruction is being sent. Clearly it is desirable to provide a means of conveying an instruction to a circuit whether or not it is currently receptive.

Another problem facing known piston telemetry systems is that of the loss of communication which occurs when the temperature of the engine rises. This is due to the fact that the frequency of the carrier wave, conveying information between the sensors and the processing unit, drifts as a function of the temperature of the circuit producing the carrier wave. This means that communication between the piston circuitry and the processing unit becomes broken, as the signal can no longer be detected by the processing unit.

Embodiments of the present invention aim to address at least partly the above mentioned problems.

SUMMARY OF THE INVENTION

The present invention is defined in the attached independent claims, to which reference should now be made. Further, preferred features may be found in the sub-claims appended thereto.

According to an aspect of the present invention there is provided a wireless remote control system comprising: a base station having a base electronic circuit; and a remote station having a remote electronic circuit comprising control means operatively arranged to control at least one device; wherein the remote electronic circuit is arranged to derive power from incident electromagnetic radiation transmitted from the base station.

According to another aspect of the invention there is provided a wireless remote control system comprising: a base station having a base electronic circuit; and a remote station having a remote electronic circuit comprising control means operatively arranged to control at least one device; wherein the remote electronic circuit is arranged to derive a clock signal from incident electromagnetic radiation transmitted from the base station.

According to another aspect of the present invention there is provided a wireless remote control system comprising: a base station having a base electronic circuit; and a remote station having a remote electronic circuit comprising control means operatively arranged to control at least one device; wherein the base station and the remote station have respectively a base coupling member and a remote coupling member which are electromagnetically coupled and at least one circuit derives information regarding the proximity of the two stations to each other from the extent to which the coupling member attached to said circuit is inductively loaded by the other coupling member.

According to another aspect of the present invention there is provided a telemetry system for use in measuring at least one condition in a hostile environment, the telemetry system comprising a remote circuit for location within a hostile environment and a base station for locating external to the hostile environment, wherein the remote circuit comprises second induction means arranged to extract electrical power from an incident electromagnetic signal, and the base station is arranged to transmit said signal to said second induction means.

Preferably said base station comprises a first induction means. In a preferred arrangement the first and second induction means comprise respectively first and second induction coils which may be loosely coupled. Preferably the coils are tuned for resonance.

The first induction means may be located within the hostile environment.

The base station may include signal generation means for generating the electromagnetic signal, which may comprise a carrier signal. The base station may include modulation and/or demodulation means for modulating and/or demodulating the carrier signal. The remote circuit may comprise an electronic processor, such as a micro controller. Preferably the remote circuit comprises one or more sensors for sensing one or more parameters in the environment. In a preferred arrangement the remote circuit includes means to derive a DC power supply from the incident signal. The remote circuit may comprise means to generate a clock signal from the incident signal.

The base station may comprise one or more filter means to filter a signal induced in the first coil. Preferably the base station includes signal processing means for extracting data from signals induced in the first coil.

According to another aspect of the present invention there is provided a telemetry circuit for use in measuring at least one condition in a hostile environment in which at least first and second members are arranged to move relative to one another, the circuit comprising: at least one sensor for electronically sensing said at least one condition, a transmitter for transmitting to a base station data corresponding to the sensed condition, an induction coil fixedly mounted in relation to the first member, and a magnet fixedly mounted in relation to the second member so as to be constrained to move in an oscillatory manner relative to the induction coil so as to induce an emf in the coil as the members move relative to one another.

The circuit may include a rechargeable power supply for providing power to the circuit. The rechargeable power supply may be arranged to be charged by the induced emf.

The circuit may be used in measuring at least one condition in an engine and preferably the telemetry circuit is arranged for use in a piston of an engine. In one aspect the present invention provides a piston, including telemetry circuitry comprising: a rechargeable power supply for providing power to the circuit; at least one sensor for sensing at least one condition inside an engine; transmitter means for the wireless transmission of data corresponding to the condition sensed by the sensor; an electrically conductive coil positioned within the piston; a connecting rod connected at a first end by a little-end bearing to the piston and connected at its other end by a big-end bearing to drive means of an engine; and at least one magnet positioned on the little-end bearing of the connecting rod and constrained to move in an oscillatory manner relative to the coil to induce an emf therein as the piston moves, for charging the power supply and/or for providing power to the circuit.

In another aspect the invention provides a piston, including a telemetry system comprising: a power supply for providing power to the circuit; at least one sensor for sensing at least one condition inside an engine; transmitter means for the wireless transmission of data corresponding to the condition sensed by the sensor; a switch for connecting the power supply to the rest of the circuit; and a device for controlling the switch, the device deriving energy from an incident radio-frequency signal, and being operable to open or close the switch, thus selectively allowing power from the power supply to be switched on and off remotely.

The invention also includes a telemetry system for a piston, including telemetry circuitry comprising: a power supply for providing power to the circuit; at least one sensor for sensing at least one condition inside an engine; transmitter means for the wireless transmission of data corresponding to the condition sensed by the sensor to a base station which includes a stored look-up table, wherein the transmitter means transmits the data in the form of a modulated carrier signal the frequency of which varies as a function of the temperature of the transmitter means; the transmitter means being arranged to transmit data corresponding to its own temperature; and wherein the base station is arranged to track the carrier frequency of the transmitter means by comparing the transmitted temperature data with temperature values stored in the look-up table.

The telemetry circuit or telemetry system may comprise a pair of resonantly coupled coils, arranged for the transmission of data therebetween, wherein the coils are constrained in use to move relative to one another, such that their mutual inductance is a function of the separation between the coils.

The remote control system, circuit, telemetry system or piston may be according to any statement herein, and may include any combination of the features described herein, except where such features are mutually exclusive.

Preferred embodiments of the invention will now be described, by way of example only, with reference to the accompanying drawings, in which:

DETAILED DESCRIPTION OF PREFERRED EMBODIMENTS

Figure 1:
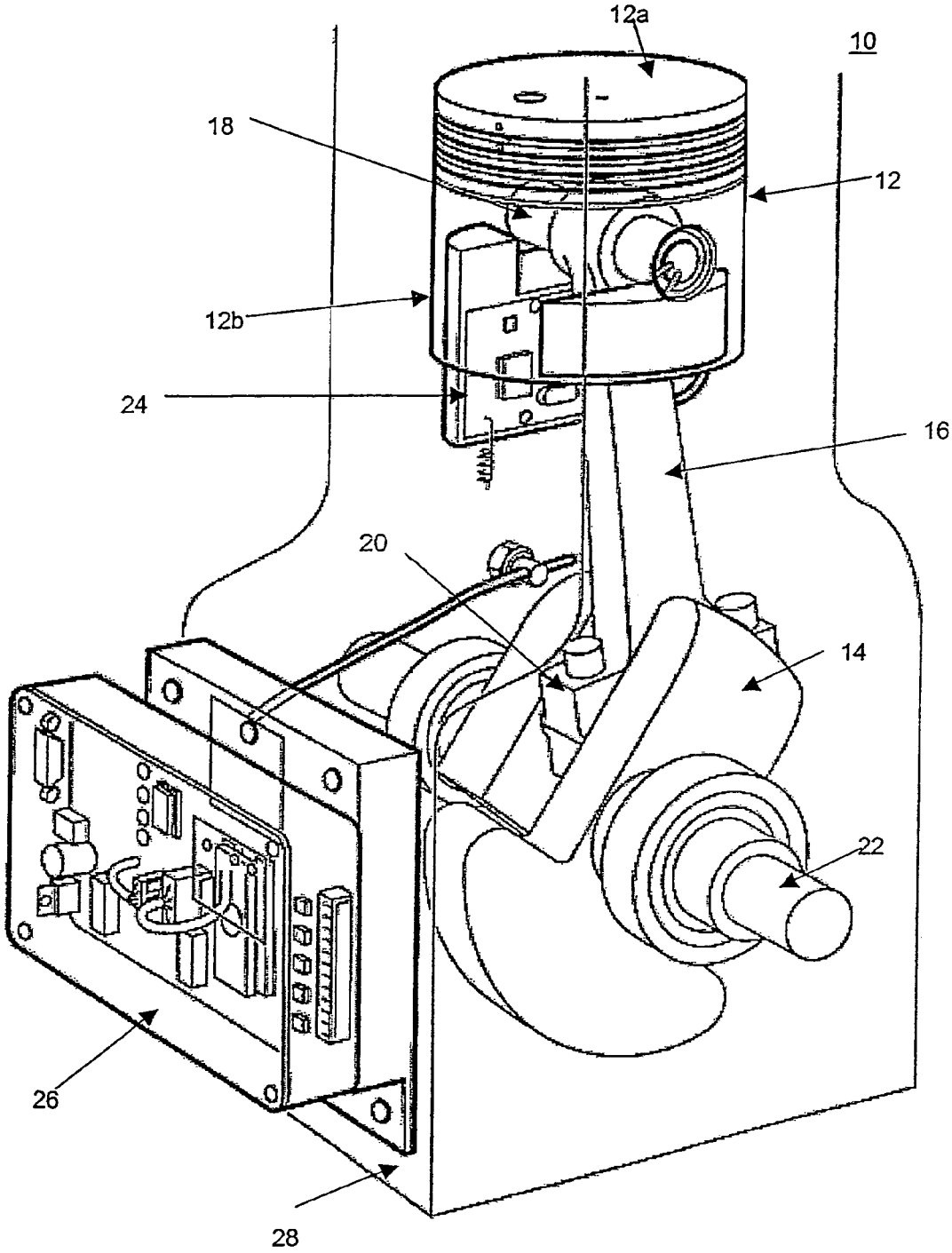
FIG. 1 is a partial cross section of an engine.

Turning to FIG. 1, this shows generally at 10 part of an internal combustion engine. A piston 12 is connected to a crank 14 by means of a connecting rod 16; the connecting rod having a little end bearing 18, with which the rod 16 is attached to the piston 12, and a big end bearing 20, with which the rod 16 is attached to the crank 14. The crank 14 turns a crankshaft 22.

The piston 12 has a crown 12*a* and a skirt 12*b*. Housed in the skirt 12*b* on the inside of the piston 12 is a sensor circuit 24, which includes one or more sensors (not shown) for monitoring one or more engine parameters, as well as a power supply and transceiver, and which will be described later. The piston circuitry 24 is arranged to communicate with a data processing unit 26 which is mounted on the exterior of a crank-case 28 outside the engine. During operation, the piston circuitry 24 transmits data from the sensors to the data processing unit 26, via suitable antennae, which then may output the data in a usable form to an operative.

Figures 2A, 2B:
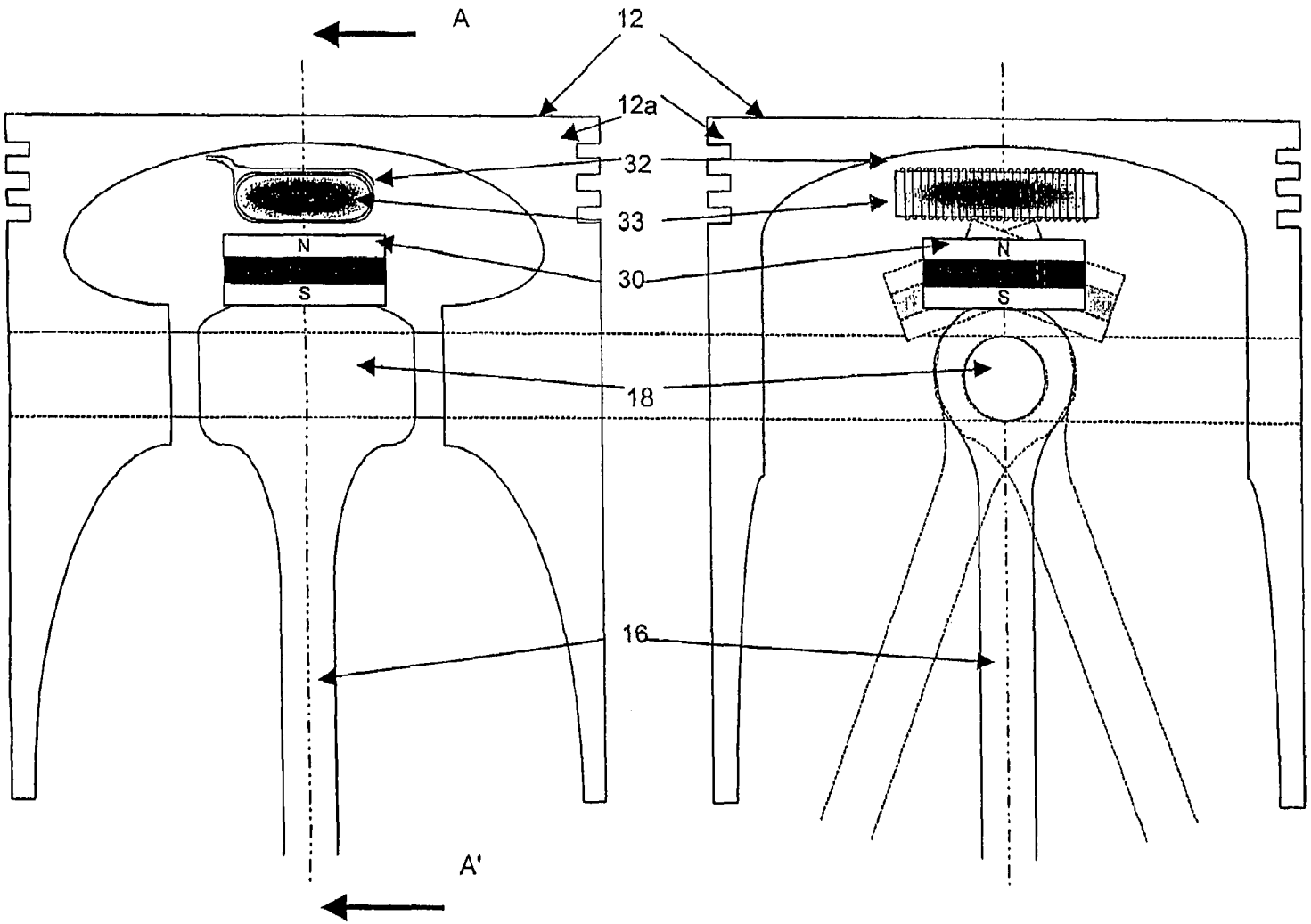
FIGS. 2*a* and 2*b* are cross sections of a piston, taken at right angles to one another.

FIGS. 2*a* and 2*b* are cross sections of the piston 12, showing the connecting rod 16, and little end bearing 18. FIG. 2*b* is the sectional view taken along line A-A= of FIG. 2*a*. A permanent magnet 30 is fixed to the little end bearing 18, by its south pole, in this example, so that its north pole faces the crown 12*a* of the piston. A solenoid 32, wound around a soft magnetic core 33, is attached to the inside of the crown 12*a* of the piston, such that the lines of magnetic flux from the permanent magnet 30 intersect the coils of the solenoid. In the operation of the engine the connecting rod 16 rocks relative to the piston; some different positions are shown, by way of example in FIG. 2*b*. This causes the magnet 30 to be moved as a pendulum in the proximity of the solenoid 32, thus inducing an electromotive force (emf) in the solenoid. The magnetic field lines from the permanent magnet are channelled by the soft magnetic core to enhance this effect in the usual way. This emf can then be used to power the sensor circuit 24 or to charge a battery by connecting the solenoid 32 to suitable charging circuitry.

In the arrangement described above a battery is still needed if data is to be obtainable when the engine is not running, using stored energy. This is useful because it allows measurements of conditions in the engine to be made while the engine is cooling, for example, and also allows pre-runtime checks to be performed.

A further benefit derives from the fact that the cyclical motion of the piston is represented in the juxtaposition of the magnet 30 and solenoid 32. Hence the cyclical emf output from the solenoid 32 follows the piston=s movement, and information about the latter can be obtained by considering the former. A similar arrangement to this could be realised in any other system with moving parts, where there is a relative motion between (at least) two moving parts, for example in a gearbox, where vibration and shock could be monitored.

Figure 3:
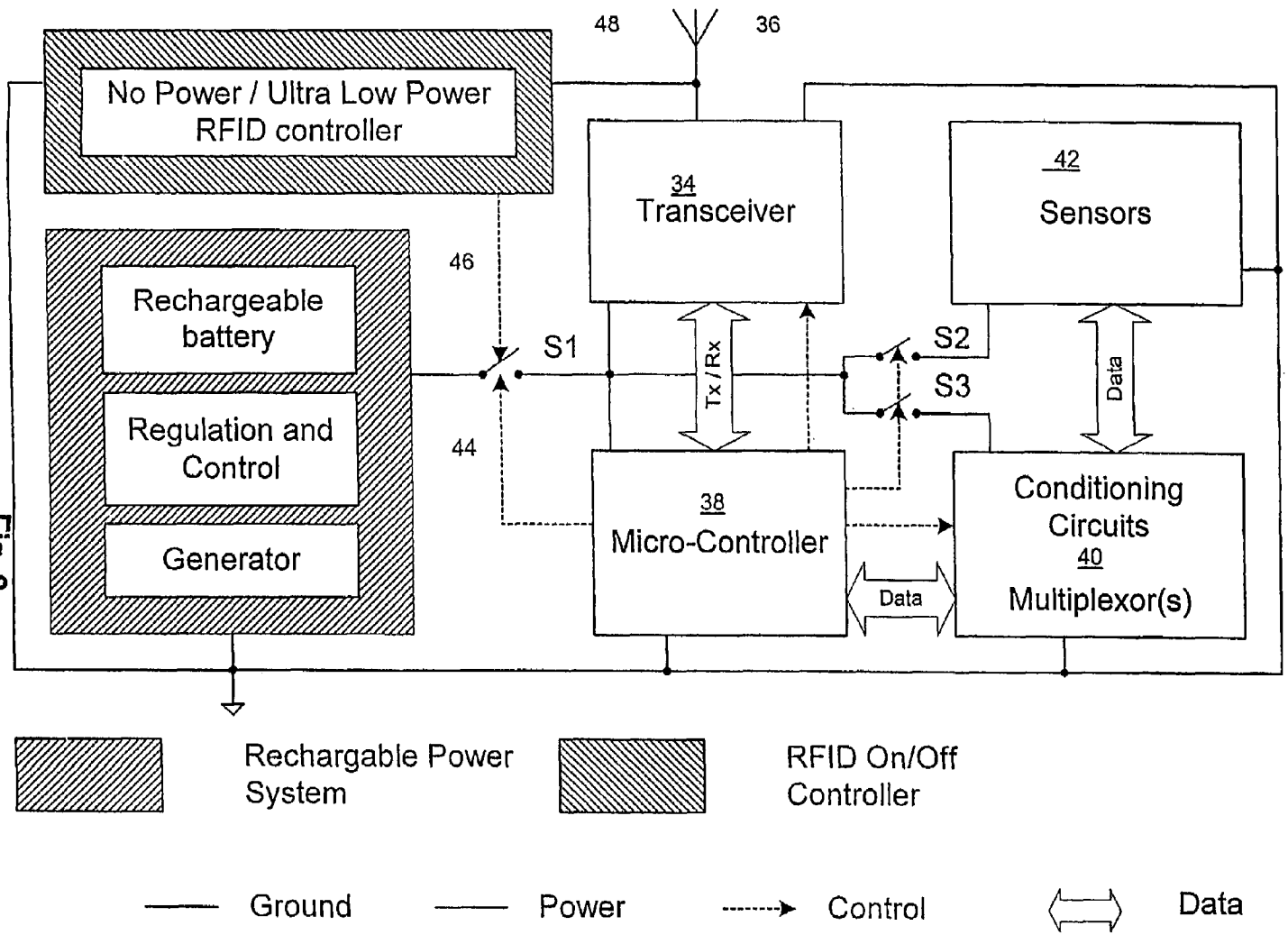
FIG. 3 shows a circuit for use in a telemetry system according to an embodiment of the present invention.

FIG. 3 shows a circuit for use in such a telemetry system. In this circuit there is a transceiver 34, which can receive and transmit signals via an antenna 36. The transceiver is connected to a micro-controller 38, which codes and decodes data for the transceiver 34. The micro-controller 38 also controls the conditioning circuits 40, which are in two-way communication with one or more sensors 42. The or each sensor may be located within the piston and may for example comprise a temperature transducer. A switch S1 connects a unit 44, containing a rechargeable battery 46 to the rest of the components in the circuit. A radio-frequency identification device (RFID) controller 48 is connected to the antenna 36. The RFID controller controls the switch S1.

In the operation of the wireless telemetry system a modulated and encoded signal is sent from an antenna of a base station (26 in FIG. 1), mounted on the interior of the crankcase. The transceiver 34 of the circuit receives the signal, and demodulates it. The signal is then sent to the micro-controller 38 where it is decoded. The information from the signal is then used to control the operation of the circuit by activating the rest of the circuit and setting the mode of operation thereof, in order to sample data from the or each sensor 42.

Switch S1 is controlled by the RFID controller 48 In this example the RFID controller 48 shares the antenna 36 of the transceiver 34, thus obviating the need for two separate antennae, which is advantageous as the space occupied by the circuit must be quite small (in alternative examples, not shown, two antennae may be required, one for the RFID and another for the transceiver). On receiving a certain coded signal from the antenna 34, the RFID controller uses energy extracted from the received signal and opens or closes the switch S1, thus allowing the circuit to be activated even when the power source is connected neither to the RFID controller nor to the rest of the circuit.

Once the circuit is activated by closing switch S1 the micro-controller is receptive to signals received from the base station 26 via the antenna 36 and transceiver 34.

When the received signal is demodulated by the transceiver unit 34 the micro-controller 38 decodes the signal and closes switches S2 and S3 as required. This provides power to the sensor(s) 42, and the unit containing the conditioning circuits and the multiplexer(s) 40, respectively.

The signal may instruct the micro-controller 38 to obtain certain data from the sensor(s) 42, via the conditioning circuits 40. The sensor(s), which could, for example comprise a thermocouple or a pressure sensing means, relay the relevant data to the circuits 40. This data is coded by the micro-controller 38 and is then sent to the transceiver 34, where it is transmitted to the base station 26, where the data is received and decoded, for presentation or storage.

This two-way transfer of data continues until the base station 26 sends a signal to the RFID controller 44 instructing it to open the switch S1, or else sends a signal to the micro-controller 38 requesting it to stop sampling data or to open the switch S1.

If simple one-way continuous operation is required the micro-controller 38 controls the sampling of data, according to a pre-set routine, until such time as the RFID 48 receives a signal from the base station 26 to open the switch S1, after which the supply of power to the circuit is interrupted and the micro-controller 38 reverts to an OFF condition. When it is necessary to re-activate the circuit, an appropriate signal is sent to the RFID 48, which then closes the switch S1 providing power to the micro-controller 38 which becomes activated and receptive to commands from the remote unit 26, which are received via the transceiver.

As discussed above, circuits such as these encounter problems during the running of the engine, when the temperature of all of the components inside the engine, including the telemetry circuit, increases. This causes problems in that the frequency of the carrier wave that is transmitted from the transceiver 34 drifts to such an extent that the signal can no longer be picked up by the antenna of the base station 26. To address this, the base station has a stored look-up table in which the relationship between the temperature of the transceiver and the frequency of the carrier signal is represented numerically. Using temperature-indicative data transmitted by the transceiver 34 and received by the base station 26, the unit 26 is able to vary the frequency of the signal which it uses to demodulate the transmission. Thus, the unit 26 is able to "track" the carrier frequency as it varies with temperature. The carrier frequency can also be modified before being transmitted by the transceiver 34, so that the output signal has a constant frequency.

Figure 4:
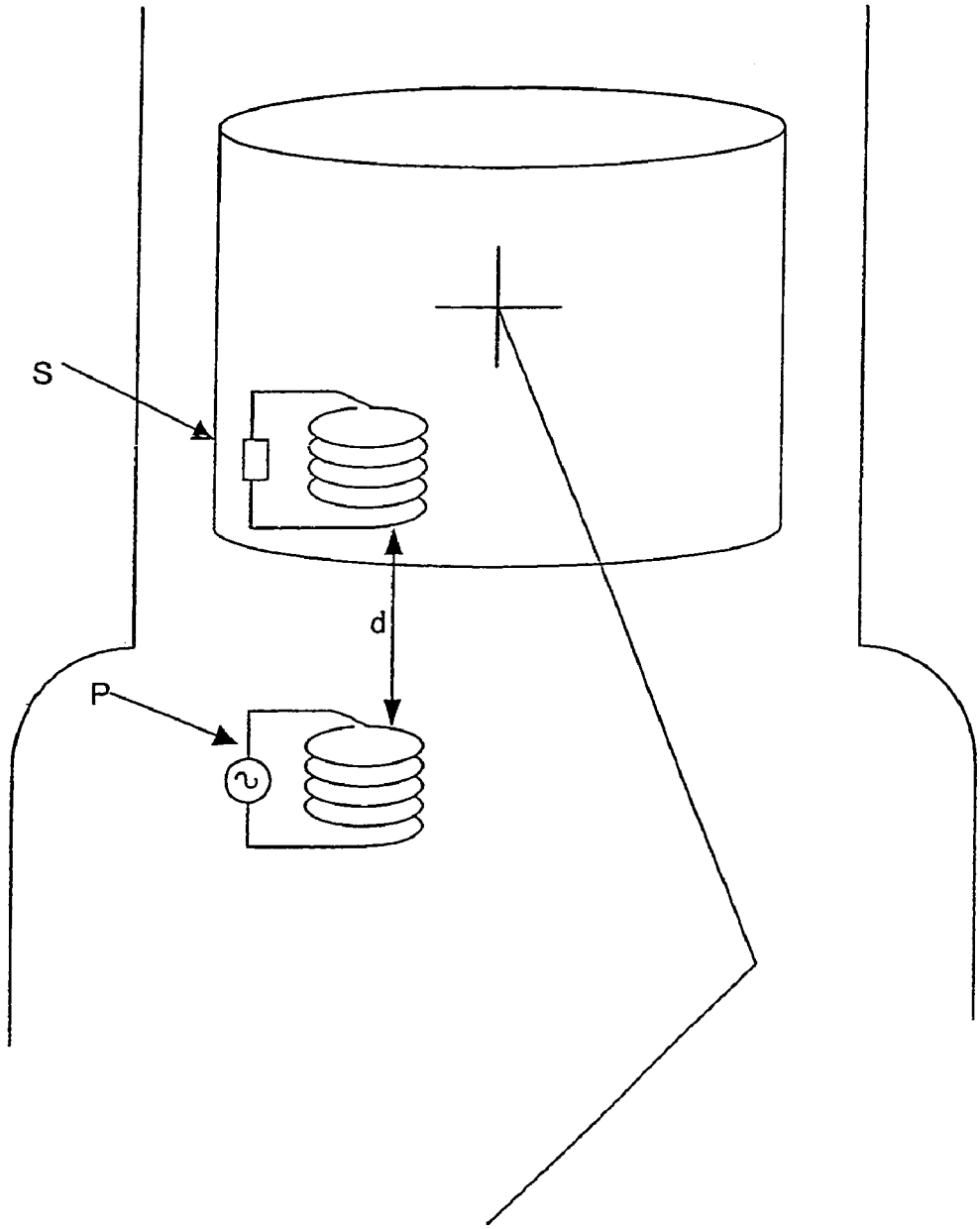
FIG. 4 shows part of the engine of FIG. 1, enlarged and depicting a preferred signal transmission apparatus.

FIG. 4 shows schematically part of the engine of FIG. 1. In this embodiment a pair of coils P and S are used as the antennae, by which the piston circuitry (not shown) communicates with the data processing unit (also not shown). In addition the coils may be used to detect the motion of the piston 12 in the cylinder (not shown). In particular, a primary coil P is located at a fixed position below the piston and a secondary coil S is mounted on or within the piston, to move therewith. An alternating current $I_P$ in the primary coil induces a signal on the secondary coil, and the mutual inductance M, and hence the current $I_P$ will vary as a function of the distance d between the coils. Similarly, the current $I_S$ in the secondary coil varies as a function of the separation of the coils. Thus, the cyclical motion of the piston may be monitored by measuring $I_P$ and/or $I_S$, and this may provide valuable information, such as timing and positional information, for example.

Figure 5:
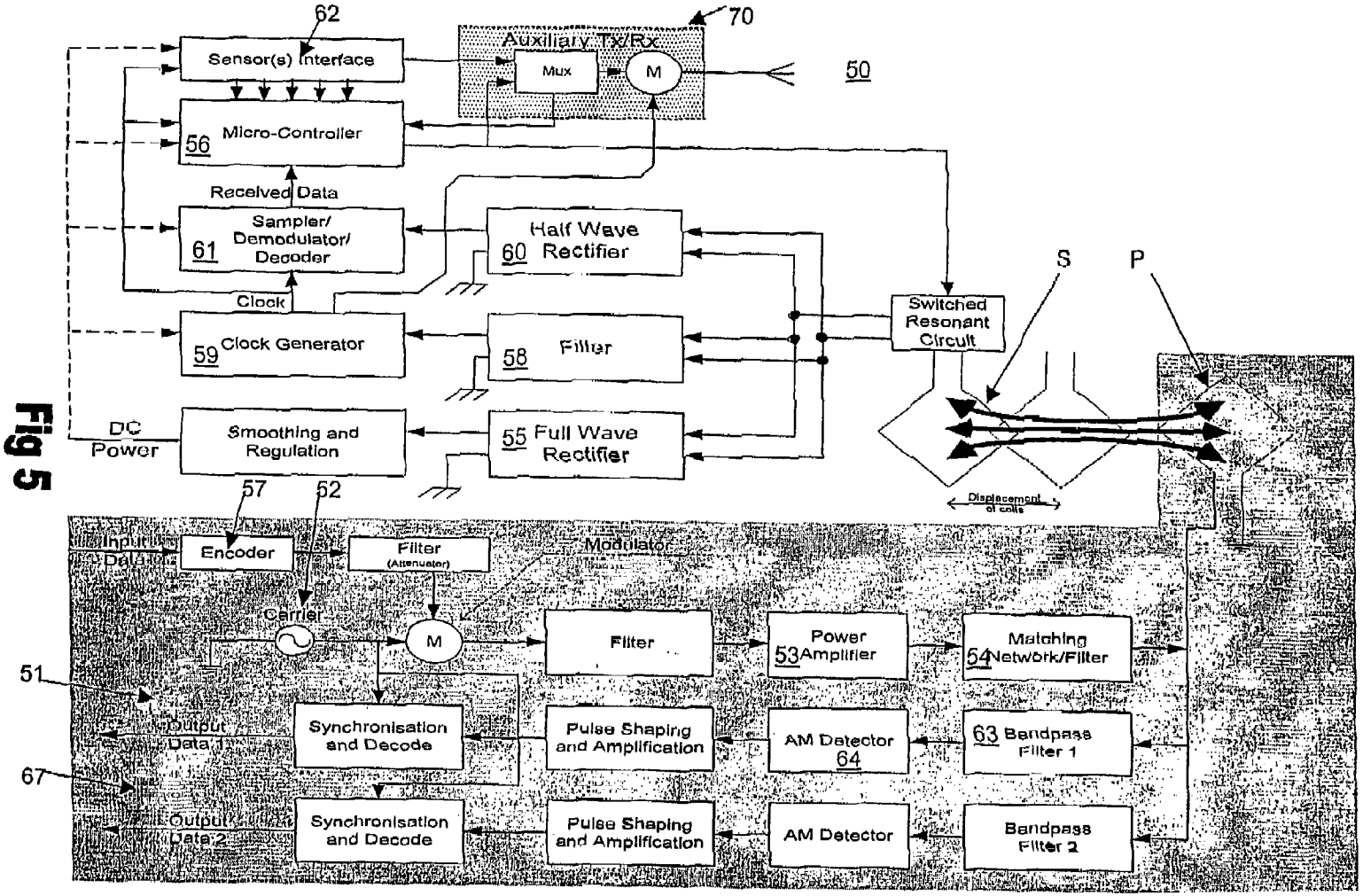
FIG. 5 shows another, preferred embodiment of telemetry circuit, including some of the features of FIGS. 1-4.

FIG. 5 shows another embodiment of telemetry circuit including some of the features of FIGS. 1 to 4.

An in-piston circuit is shown generally at 50 whilst an external processing unit mounted on the exterior of the crankcase is shown generally at 51.

In basic operation, a carrier signal generated in the external processing unit 51 is fed to a primary coil P located within the crankcase. A secondary coil S, loosely coupled to coil P and tuned for resonance therewith is located in the skirt of the piston (not shown). The secondary coil S picks up the carrier signal from the primary coil and the carrier signal is rectified, smoothed and regulated to provide DC power to the piston circuit 50, which in this case includes a microcontroller. The micro controller may use data from a number of sensors to modulate the signal in the secondary coil, which modulation is picked up by the primary coil and thus the sensor data is transmitted to the external processing unit 51 where it is filtered and decoded.

In a simple case, where the carrier signal is not modulated prior to transmission from the external processing unit 51 to the in-piston circuit 50, the carrier signal is generated at 52, amplified by amplifier 53 and then passed through a bandpass filter 54 before being supplied to primary coil P. The alternating signal in P is picked up by the secondary coil S since the coils are loosely coupled and tuned for resonance. A first full-wave rectifier 55 rectifies the signal picked up by the coil and the full-wave rectified signal is smoothed and regulated to provide a DC power supply to a micro controller 56. The micro controller may be configured such that the appearance of a DC voltage at a particular pin switches it on.

In this simple case some information may be obtained from the piston without employing any sensors. In particular it is possible to obtain information about the position of the piston in its cycle from the effect of the separation of the coils on the mutual inductance. The mutual inductance linking the coils varies as a function of their separation, which changes according to the position of the piston in a cylinder. In turn, the varying mutual inductance affects the load on the primary coil which is reflected as changes in the current flowing through the primary coil, which may be monitored. Timing information for several cylinders may thus be obtained from considering the variation in current flowing through the primary coil in each case. No additional sensor circuitry, nor indeed even a microcontroller is needed if this is all the information that is required. This information can also be used by the remote circuit; the load on the secondary coil will also vary as a function of the separation of the coils. Thus, the remote circuit can determine the location of the piston. This information can then be used, for example, to obtain a sample from inside the engine when the piston is at a certain position in its cycle.

In practice it may be useful to include a microcontroller even when no sensors are present. For example, if proximity detection by measurement of inductive loading is the only facility the remote circuit is capable of, the remote circuit could carry information or a serial number to this effect. This would allow the base station to be notified of the capabilities and/or limitations of the remote circuit.

If more information is needed such as accessing different sensors, for example, then control data must be transmitted from the base station to the piston circuit, and this may be achieved by modulation of the carrier signal. In such a case a modulator M modulates the carrier signal using encoded data from encoder 57. The modulated carrier signal is then amplified and filtered as shown in FIG. 5, as with the simple case described above, before being transmitted between the coils P and S. DC power is derived in the same way as before. In addition, a filter (and/or full-wave rectifier) 58 rectifies the received signal to produce a signal which is processed (pulse-shaped) at 59 to provide a clock signal, the frequency of which is twice that of the carrier signal. Alternatively, a harmonic of the fundamental frequency of the carrier signal can be used to provide a clock signal, for example the second harmonic (having a frequency double that of the carrier frequency). This can be used to generate a faster clock-signal.

The filter 58 can also monitor whether the circuit is de-tuning. If such de-tuning is detected, for example because of displacement of the piston, the rest of the circuit has to compensate for the resultant loss in power.

The received signal is half-wave rectified at 60 before being sampled, demodulated and decoded at 61 to recover the data signal which the micro controller uses to select and if necessary turn on the various sensors 62 for measuring different parameters within the engine.

Signals from the sensors may be digitised and, dependent on the instructions received by the micro controller, the analogue or digitised signals from a selected sensor may be transmitted by an auxiliary transceiver 70, at a higher frequency than the carrier signal if a harmonic of the carrier frequency is used by the circuit. A mixer from the clock signal is used, and a modulator circuit is connected to the transceiver. Thus, the circuit uses two channels: the carrier frequency is used to send the signal, and the data is sent out of the circuit on a different channel of higher frequency. Alternatively, the analogue or digitised signals from a sensor may be used to modulate the load on the secondary coil S.

Because the coils are coupled resonantly the modulation of the loading of coil S by the micro-controller may be detected in coil P. A first bandpass filter 63 filters the signal which then is processed through stages of amplitude modulation detection, and pulse shaping and amplification, respectively at 64 and 65, before being decoded at 66 and output as the required data.

A second filter/detector/shaper/decoder branch shown generally at 67 performs the same processing operations on the signal, using a different bandpass filter to obtain signals modulated at a different order of frequency. For example, the first filter 63 may be arranged to pass frequencies in the range of several megahertz for deriving a data signal from the micro controller which represents the reading of one of the sensors 62. On the other hand a second bandpass filter in the branch 67 may pass frequencies in the range of several hundred hertz, which may be representative of the changes in mutual inductance between coils P and S as a result of the movement of the piston.

Since DC power and a clock signal can be supplied to the in-piston circuit 50 from the external processing circuit 51 via the coupling of primary and secondary coils, there is no need in this embodiment to provide a local power supply (i.e. battery) or a local oscillator. This provides an advantage as the performance of such components is affected by the high temperatures found inside the operational piston.

Additionally, in applications which are particularly weight-sensitive, such as in the monitoring of high performance engines, the ability to obtain results without components such as a battery or local oscillator is of great benefit.

Government legislation limits the intensity and frequency of RF carrier waves which can be transmitted openly, and radiation conforming to this legislation would not be capable of generating sufficient power in a currently allowable Radio Frequency Identification Device (RFID) to enable the RFID to take the place of a conventional power source in most circuits.

However, a circuit for use in a telemetry system as described above may be housed in a metal casing, for example an engine, which acts as a Faraday cage. This means that radiation which would not otherwise conform to the Government's legislation can be generated inside such a metal cage without leaking to the outside. Thus a telemetry circuit housed in a metal object can be provided with sufficiently high-powered incident radiation to eliminate the need for an alternative power source, whilst remaining legal.

Obviously, for this to be the case the primary induction coil must be housed inside the crankcase.

One particularly useful application of such a telemetry system is to monitor the temperatures of different regions in an engine. For example, it may be detected that certain pistons become hotter than others. This information will be conveyed to the base station, outside the engine, by the respective pistons. The hotter pistons may then be cooled more by directing more oil to them, thereby ensuring that the temperature of the engine is uniform throughout. Embodiments of the invention may be used to monitor conditions in other hostile environments and are not limited to use in automotive telemetry systems.

What is claimed:

1. A wireless remote control system comprising:

a base station having a base electronic circuit that transmits electromagnetic radiation; and a remote station electromagnetically coupled to the base section and having a remote electronic circuit comprising control means operatively arranged to control at least one device and arranged in a path of the electromatic radiation from the base power station;

wherein the remote electronic circuit is constructed and arranged to also derive power from incident electromagnetic radiation transmitted from the base station; and wherein the base station and the remote station have respectively a base coupling member and a remote coupling member which are electromagnetically coupled and the system comprises at least one circuit that derives information regarding the proximity of the two stations to each other from the extent to which the coupling member attached to said circuit is inductively loaded by the other base coupling member.

2. A system according to claim 1, wherein the remote electronic circuit is constructed and arranged to also derive a clock signal from the incident electromagnetic radiation transmitted from the base station.

3. A wireless remote control system according to claim 1, wherein the base station and the remote station are loosely inductively coupled.

4. A wireless remote control system according to any one of claims 1-2 wherein said at least one device comprises a sensor arranged in use of the device to sense a physical condition in an environment of the remote station.

5. A wireless remote control system according to any one of claims 1-2, comprising a wireless telemetry system arranged for two-way communication between the base station and the remote station.

6. A wireless remote control system according to claim 2 wherein the clock signal is derived from a fundamental frequency of a carrier signal transmitted by the base station.

7. A wireless remote control system according to claim 1 wherein the clock signal is derived from a fundamental frequency of a carrier signal transmitted by the base station.

8. A wireless remote control system according to claim 2 wherein the clock signal is derived from a harmonic frequency of a carrier signal transmitted by the base station.

9. A wireless remote control system according to claim 1 wherein the clock signal is derived from a harmonic frequency of a carrier signal transmitted by the base station.

10. A wireless remote control system according to claim 2 wherein a plurality of clock signals are derived from the fundamental and at least one harmonic frequency of a carrier signal transmitted by the base station.

11. A wireless remote control system according to claim 1 wherein a plurality of clock signals are derived from the fundamental and at least one harmonic frequency of a carrier signal transmitted by the base station.

12. A wireless remote control system according to claim 1 wherein the remote station has a plurality of transmitting means and/or receiving means arranged to transmit and/or receive at different carrier frequencies.

13. A wireless remote control system according to claim 11 wherein the remote station has a plurality of transmitting means and/or receiving means arranged to transmit and/or receive at different carrier frequencies.

* * * * *